US009940903B2

(12) United States Patent
Najarian et al.

(10) Patent No.: US 9,940,903 B2
(45) Date of Patent: Apr. 10, 2018

(54) SYSTEM AND METHOD FOR MANAGING, PUBLISHING AND MANIPULATING DATA OBJECTS

(75) Inventors: John Najarian, Los Angeles, CA (US); Gerald Abrahamian, Los Angeles, CA (US); Darren Hand, Los Angeles, CA (US); Timothy Mohn, Los Angeles, CA (US); Lou Houlemarde, Los Angeles, CA (US); Daniel Houlemarde, Los Angeles, CA (US); Trinh Nguyen, Los Angeles, CA (US)

(73) Assignee: NBCUniversal Media, LLC, New York, NY (US)

( * ) Notice: Subject to any disclaimer, the term of this patent is extended or adjusted under 35 U.S.C. 154(b) by 52 days.

(21) Appl. No.: 13/570,013

(22) Filed: Aug. 8, 2012

(65) Prior Publication Data

US 2013/0328912 A1 Dec. 12, 2013

Related U.S. Application Data

(60) Provisional application No. 61/656,833, filed on Jun. 7, 2012.

(51) Int. Cl.
*G09G 5/00* (2006.01)
*G09G 5/14* (2006.01)

(52) U.S. Cl.
CPC ..... *G09G 5/14* (2013.01); *G09G 2340/145* (2013.01)

(58) Field of Classification Search
USPC ..... 345/619
See application file for complete search history.

(56) References Cited

U.S. PATENT DOCUMENTS

2005/0261826 A1* 11/2005 Kurosawa et al. ..... 701/208
2005/0283734 A1* 12/2005 Santoro et al. ..... 715/765
2006/0262218 A1* 11/2006 Querre ..... 348/468
2007/0168859 A1* 7/2007 Fortes ..... 715/700
2007/0174782 A1* 7/2007 Russo ..... G06F 3/04817 715/781
2007/0180401 A1* 8/2007 Singh ..... G06F 3/0481 715/794
2009/0144150 A1* 6/2009 Sakakibara et al. ..... 705/14
2009/0204927 A1* 8/2009 Terasaki ..... 715/781
2009/0249247 A1* 10/2009 Tseng ..... H04M 1/72552 715/808
2011/0161852 A1* 6/2011 Vainio et al. ..... 715/769
2011/0288928 A1* 11/2011 Patwa ..... G06Q 30/02 705/14.42
2011/0320319 A1* 12/2011 Streich ..... 705/27.1
(Continued)

*Primary Examiner* — Kyle Zhai

(57) ABSTRACT

Apparatus and methods for managing, manipulating and presenting data objects within a graphical user interface with variable dimensions, shapes, locations and interactions. The apparatus and methods allow for variable data objects to be both pinned and liquid depending on a larger management and manipulation apparatus. The apparatus consists of databases that store the data objects to be displayed within the user interface and the layout coordinates, variable potential object size, and whether the object can move or not based on the graphical user interface dimensions. The object manipulations include the representation of such objects on the graphical user interface in a defined sequence.

22 Claims, 13 Drawing Sheets

(56) References Cited

U.S. PATENT DOCUMENTS

| | | | | |
|---|---|---|---|---|
| 2012/0096098 | A1* | 4/2012 | Balassanian | G06Q 50/01 709/206 |
| 2012/0169934 | A1* | 7/2012 | Putterman et al. | 348/565 |
| 2012/0282914 | A1* | 11/2012 | Alexander | H04M 1/72527 455/420 |
| 2013/0014040 | A1* | 1/2013 | Jagannathan | G06Q 50/01 715/765 |
| 2013/0325572 | A1* | 12/2013 | Plut | G06Q 30/0241 705/14.16 |

* cited by examiner

333

324

222

| Data Object | Priority | X-Y Coordinates | Size | Movability |
|---|---|---|---|---|
| Top Stories | 1 | -1, 1 | 320x500 | Liquid |
| Photo Gallery 1 | 2 | 0, 1 | 320x450 | Pinned |
| Twitter Feed | 3 | -1, 0 | 320x250 | Liquid |
| Video 1 | 4 | 1, 1.5 | 320x250 | Pinned |
| Archived Stories | 5 | -1, -1 | 320x480 | Liquid |
| Video 2 | 6 | 0, -0.5 | 320x250 | Liquid |
| Photo Gallery 2 | 7 | 0, | 320x450 | Liquid |
| Video 2 | 8 | 0, -1.5 | 320x450 | Liquid |
| Facebook Feed | 9 | -1, -2 | 320x500 | Liquid |
| Video 3 | 10 | 0, -1.5 | 320x450 | Liquid |

222

FIG. 3B

SYSTEM AND METHOD FOR MANAGING, PUBLISHING AND MANIPULATING DATA OBJECTS

CROSS-REFERENCE TO RELATED APPLICATION

This application claims priority from U.S. Provisional Application No. 61/656,833, filed Jun. 7, 2012, entitled "System and Method for Managing, Publishing, and Manipulating Data Objects," by Najarian et al., which is hereby incorporated by reference.

BACKGROUND OF THE INVENTION

When displaying content blocks within a graphical user interface, existing dynamic layout systems simply take into consideration the lowest value of a slot within the graphical user interface in one dimension, typically the vertical X value. These systems display the content in a particular location with the lowest X value, even though, for example, that location may be to the far right of the user interface when another area is available all the way to the left that appears to be about the same X value. Moreover, existing dynamic layout systems do not take into consideration the size of the content itself when placing content blocks, that is, a small content block will get the same placement decision as larger one.

Additionally, existing layout systems fail to take into consideration the logical nuances of placing content blocks of varying width within a graphical user interface.

BRIEF SUMMARY OF THE INVENTION

Accordingly, a need exists for a system to place prioritized content blocks in the most important relative areas within a graphical user interface, rather than sporadically based on small differences as little as one pixel.

Embodiments of the present invention are directed towards an apparatus including a memory device and a processor. The memory device includes a first database and a second database. The first database is operable to store a number of data objects and the second database is operable to store a number of object properties for the data objects. The processor is operable to dynamically manipulate the number of data objects based on a predefined criteria and is also operable to display the number of data objects within a graphical user interface. The number of data objects are dynamically manipulated by altering the number of object properties in response to a change in dimensions of the graphical user interface. The graphical user interface includes a number of columns.

Another embodiment of the present invention is directed towards a method. The method includes preparing a layout area within a graphical user interface for displaying a number of data objects based on dimensions of the graphical user interface. The method also includes accessing and reading object properties of the number of data objects stored in a memory device. After accessing and reading the object properties, the method includes dynamically manipulating the object properties based on the dimensions of the graphical user interface to position the number of data objects within the layout area. The method concludes by displaying the number of data objects within the graphical user interface.

Other embodiments of the present invention are directed towards another method. The method includes preparing a layout area within a graphical user interface for displaying a number of data objects based on dimensions of the graphical user interface. The method also includes dynamically manipulating the number of data objects based on the dimensions of the graphical user interface to position the plurality of data objects within the layout area. After dynamically manipulating the number of data objects, the method includes positions the number of data objects within the layout area and incrementing a counter upon placement of each of the number of data objects. The method then positions a number of advertisement blocks within the layout area wherein each of the number of advertisement blocks is positioned upon the counter exceeding a predefined threshold value. The method concludes by displaying the number of data objects and the number of advertisement blocks within the graphical user interface.

BRIEF DESCRIPTION OF THE DRAWINGS

The present invention is illustrated by way of example, and not by way of limitation, in the figures of the accompanying drawings and in which like reference numerals refer to similar elements.

FIG. 3B depicts a plurality of object properties stored within a database in a tabular format, in accordance with one embodiment of the present invention.

DETAILED DESCRIPTION OF THE INVENTION

Reference will now be made in detail to embodiments of the present invention, examples of which are illustrated in the accompanying drawings. While the present invention will be discussed in conjunction with the following embodiments, it will be understood that they are not intended to limit the present invention to these embodiments alone. On the contrary, the present invention is intended to cover alternatives, modifications, and equivalents which may be included with the spirit and scope of the present invention as defined by the appended claims. Furthermore, in the following detailed description of the present invention, numerous specific details are set forth in order to provide a thorough understanding of the present invention. However, embodiments of the present invention may be practiced without these specific details. In other instances, well-known methods, procedures, components, and circuits have not been described in detail so as not to unnecessarily obscure aspects of the present invention.

For expository purposes, the term "horizontal" as used herein refers to a plane parallel to the plane or surface of an object, regardless of its orientation. The term "vertical" refers to a direction perpendicular to the horizontal as just defined. Terms such as "above," "below," "bottom," "top," "side," "higher," "lower," "upper," "over," and "under" are referred to with respect to the horizontal plane.

Figure 1:
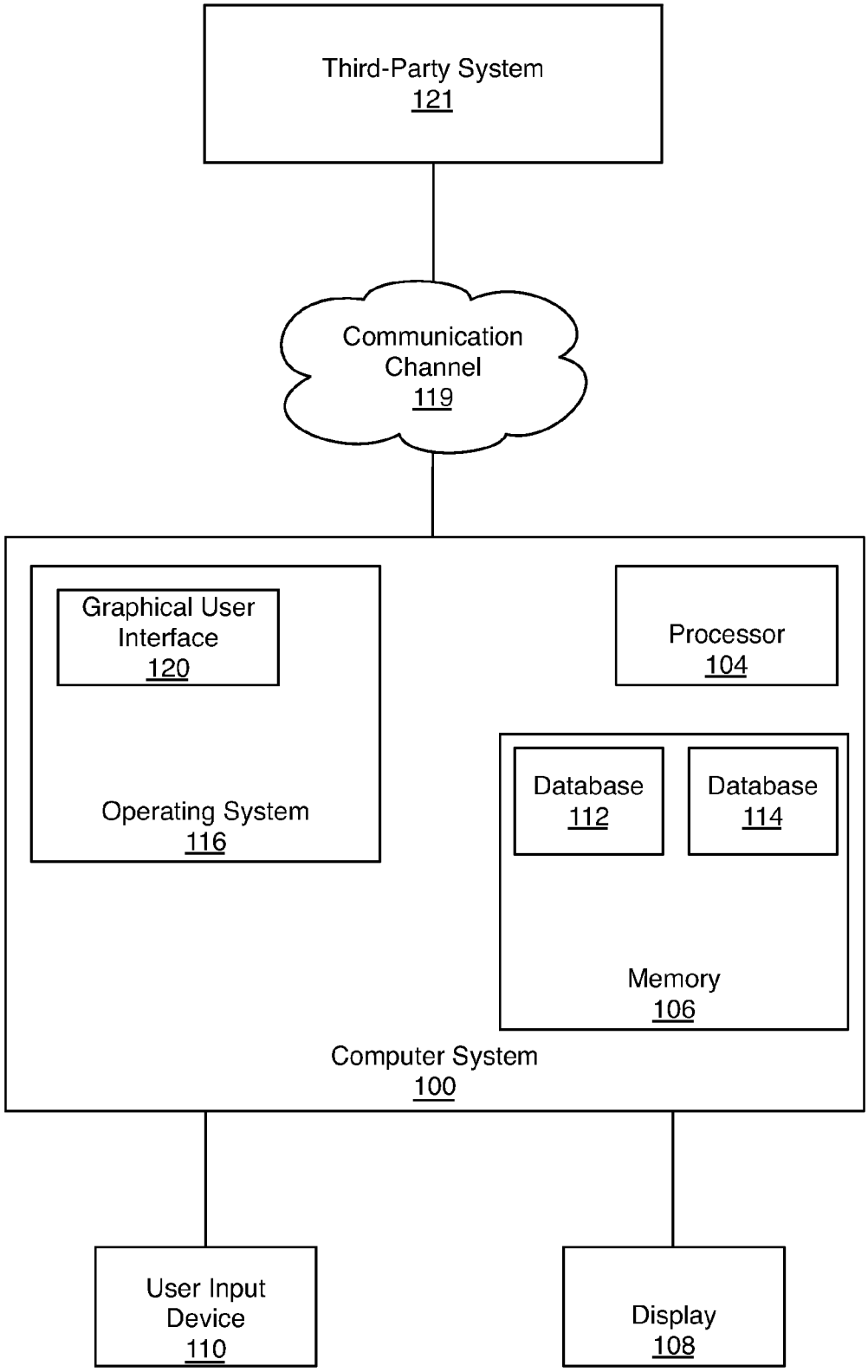
FIG. 1 depicts a computer system comprising a graphical user interface, in accordance with one embodiment of the present invention.

FIG. 1 depicts a computer system 100 comprising a graphical user interface 120, in accordance with one embodiment of the present invention. Computer system 100 is a general-purpose computer intended to be used by an end user. Computer system 100 comprises processor 104, memory device 106, and operating system 116. Memory device 106 comprises a first database 112 and a second database 114. First database 112 and second database 114 are operable to store data used by computer system 100. Processor 104 is operable to execute instructions within computer system 100. Operating system 116 may be any general-purpose operating system for managing computer system 100 resources and providing common services for computer system 100 software. Operating system 116 generates a graphical user interface (GUI) 120 that allows an end user to interact with computer system 100 via user input device 110.

Computer system 100 may also include a power supply (not shown) and data storage drives (not shown). Display device 108 is coupled to computer system 100 and displays content generated by computer system 100. User input device 110 is coupled to computer system 100 and is used by an end user to interact with computer system 100. Typical user input devices include a keyboard and a mouse. User input device 110 may be coupled to computer system 100 using wireless technology. An end user may also use finger gestures or touch capability on display device 108 as an alternative to user input device 110. Additionally, display device 108 may operate at multiple display resolutions, typically dependent upon the size of the display device. For example, display device 108 may have a resolution of 1024×768, 1900×1200, 2560×1600, or any other typical display resolution.

Computer system 100 may also communicate with a third-party system 121 via a communication channel 119. In an embodiment, The communication channel may be the Internet. Content accessed from third-party system 121 can be managed by computer system 100.

Figure 2:
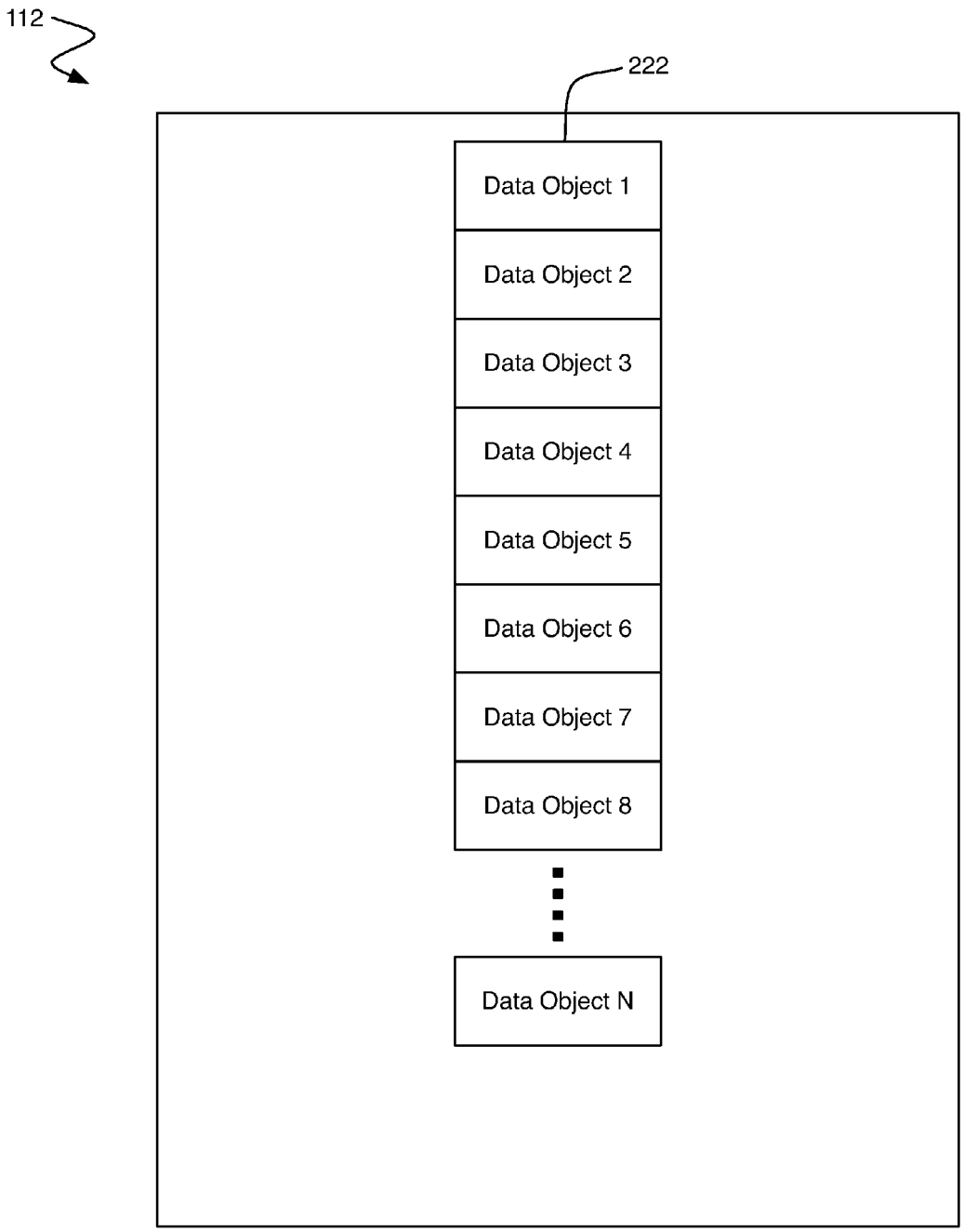
FIG. 2 depicts a database storing a plurality of data objects, in accordance with one embodiment of the present invention.

FIG. 2 depicts a database storing a plurality of data objects 222, in accordance with one embodiment of the present invention. Specifically, FIG. 2 depicts first database 112 storing a plurality of data objects 222 intended to be displayed on GUI 120 (FIG. 1). First database 112 is a part of computer system 100 (FIG. 1) and resides within memory device 106 (FIG. 1).

Data objects 222 may be, for example, text, photo, and video content. Data objects 222 may also be any other type of data intended for display on GUI 120 (FIG. 1). The present invention includes an apparatus and method for dynamically manipulating data objects 222 for display on GUI 120 (FIG. 1). In one embodiment, the manipulation of data objects 222 results in displaying data objects 222 on GUI 120 (FIG. 1) in a two-dimensional tessellated pattern, described in further detail below.

Figure 3A:
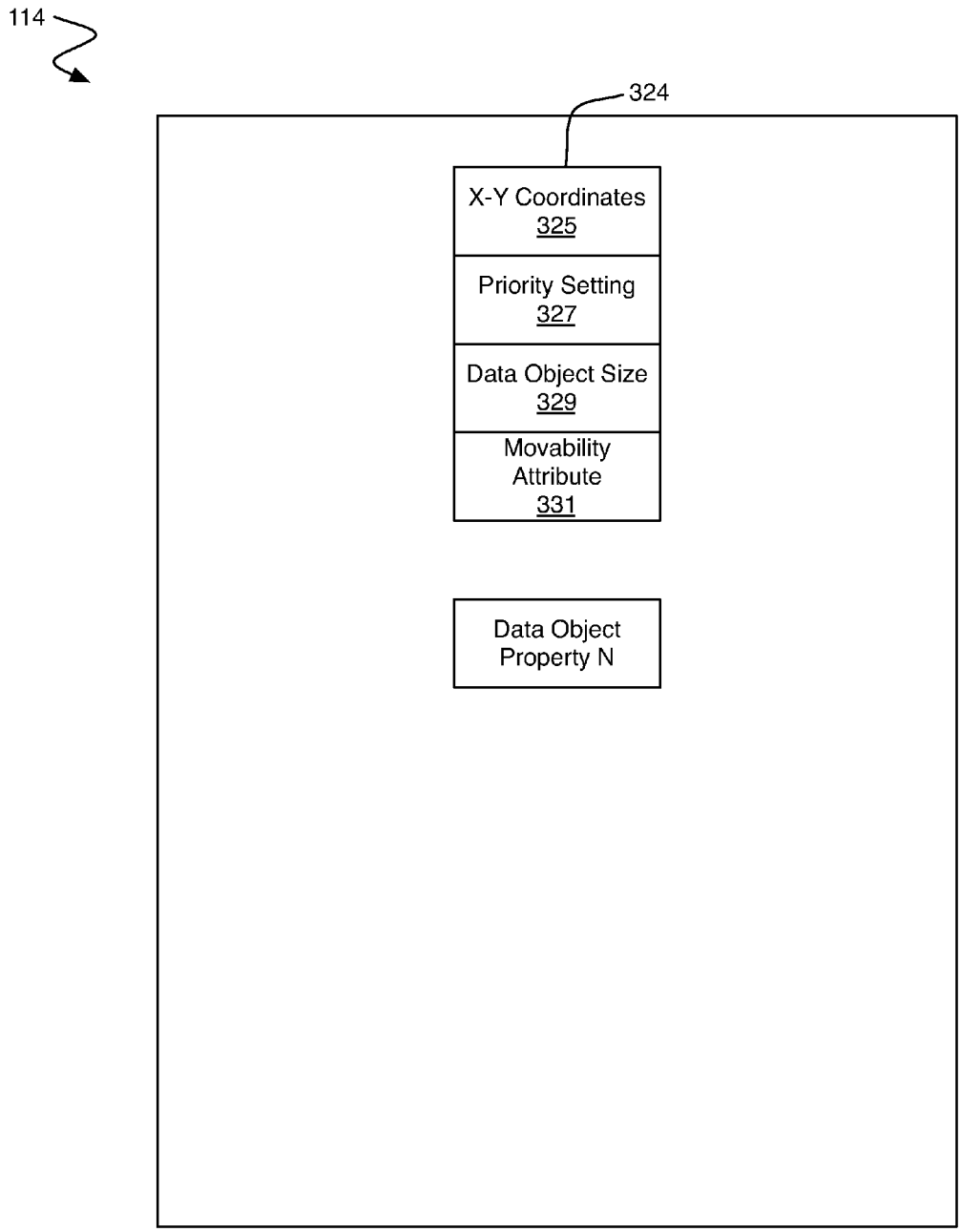
FIG. 3A depicts a database storing a plurality of object properties, in accordance with one embodiment of the present invention.

FIG. 3A depicts a database storing a plurality of object properties 324, in accordance with one embodiment of the present invention. Specifically, FIG. 3A depicts second database 114 storing a plurality of object properties 324. Second database 114 is a part of computer system 100 (FIG. 1) and resides within memory device 106 (FIG. 1). The plurality of object properties 324 are associated with each data object 222 (FIG. 2). Object properties 324 for data objects 222 (FIG. 2) include: x-y coordinates, priority setting, data object size, and movability attribute.

The X-Y coordinates object property 325 defines positional coordinates for a data object 222 (FIG. 2) within GUI 120 (FIG. 1). The position of each data object 222 (FIG. 2) is defined using a two-dimensional Cartesian coordinate system, wherein the x-axis is taken to be horizontal and the y-axis is taken to be vertical.

The priority setting object property 327 defines a priority for each data object 222 (FIG. 2). The priority for the data object 222 (FIG. 2) is used by the system in determining the placement of the data object 222 (FIG. 2) within the GUI 120 (FIG. 1). Based on predefined rules, data objects 222 (FIG. 2) with a higher priority setting 327 will be placed in more favorable positions within the GUI 120 (FIG. 1) while data objects 222 (FIG. 2) with a lower priority setting 327 will be placed in less favorable positions within the GUI 120 (FIG. 1). In an embodiment, the priority setting object property 327 may be a number in a linear scale, e.g. the priority setting 327 may be 4, on a scale of 1 to 10. In another embodiment, the priority setting object property 327 may be high, medium, or low.

The data object size object property 329 defines the dimensions for each data object 222 (FIG. 2). Data objects size 329 comprises a height and a length, defined in terms of pixels. For example, a data object 222 (FIG. 2) may comprise a width of 320 pixels and a height of 500 pixels. The system may alter the data object size property 329 when positioning a data object 222 (FIG. 2) within the GUI 120 (FIG. 1). In an embodiment, the width of a data object 222 (FIG. 2) is fixed while the system dynamically alters the height of the data object 222 (FIG. 2) for optimal placement within the GUI 120 (FIG. 1).

The movability attribute object property 331 defines whether a data object 222 (FIG. 2) may be repositioned to a different x-y coordinate within the GUI 120 (FIG. 1). The movability attribute object property 331 for a particular data object 222 (FIG. 2) may be set to either pinned or liquid. A data object 222 (FIG. 2) is pinned when, according to a predefined rule, its position within the GUI 120 (FIG. 1) is fixed and the system may not alter its x-y coordinate object property 325. A data object 222 (FIG. 2) is dynamic when the system may alter its x-y coordinate object property 325 for optimal placement of the data object 222 (FIG. 2) within the GUI 120 (FIG. 1). In an embodiment, data objects 222 (FIG. 2) having a dynamic movability attribute object property 331 are positioned around data objects 222 (FIG. 2) having a pinned movability attribute object property 331.

It can be appreciated that second database 114 may store other object properties 324 other than those mentioned above. Database 114 may store up to N object properties, where N may be governed by the system and/or hardware.

FIG. 3B depicts a plurality of object properties 324 for data objects 222 stored within a database in a tabular format, in accordance with one embodiment of the present invention. Specifically, table 333 displays object properties 324 for a plurality of data objects 222: Top Stores, Photo Gallery 1, Twitter Feed, Video 1, Archived Stories, Video 2, Photo Gallery 2, Video 2, Facebook Feed, and Video 3. Each data object may be, for example, text, photo, or video content.

Table 333 displays object properties 324 in-line for each of the mentioned data objects 222. For example, data object "Photo Gallery 1" has the following object properties: priority 2, x-y coordinates (0, 1), size 320×450, and pinned. Therefore, "Photo Gallery 1" is given a higher priority than all other data objects except "Top Stories" (assuming 1 is the highest priority and 10 is the lowest priority), is placed in the middle of the vertical axis within the GUI and offset towards the top on the horizontal axis within the GUI 120 (FIG. 1), has a size of 320×450 pixels, its position can not be changed by the system and other liquid data objects will be arranged around "Photo Gallery 1."

In another example, data object "Video 2" has the following object properties: priority 8, x-y coordinates (0, −1.5), size 320×450, and liquid. Therefore "Video 2" is given a lower priority than all other data objects except "Facebook Feed" and "Video 3," is placed in the middle of the vertical axis within the GUI 120 (FIG. 1) and offset towards the bottom on the horizontal axis within the GUI, has a size of 320×450 pixels, and its position can be changed by the system to be placed in an optimal position within the GUI 120 (FIG. 1).

The following series of figures illustrate how the data objects 222 and their corresponding object properties 324 display within the GUI 120 (FIG. 1).

Figure 4:
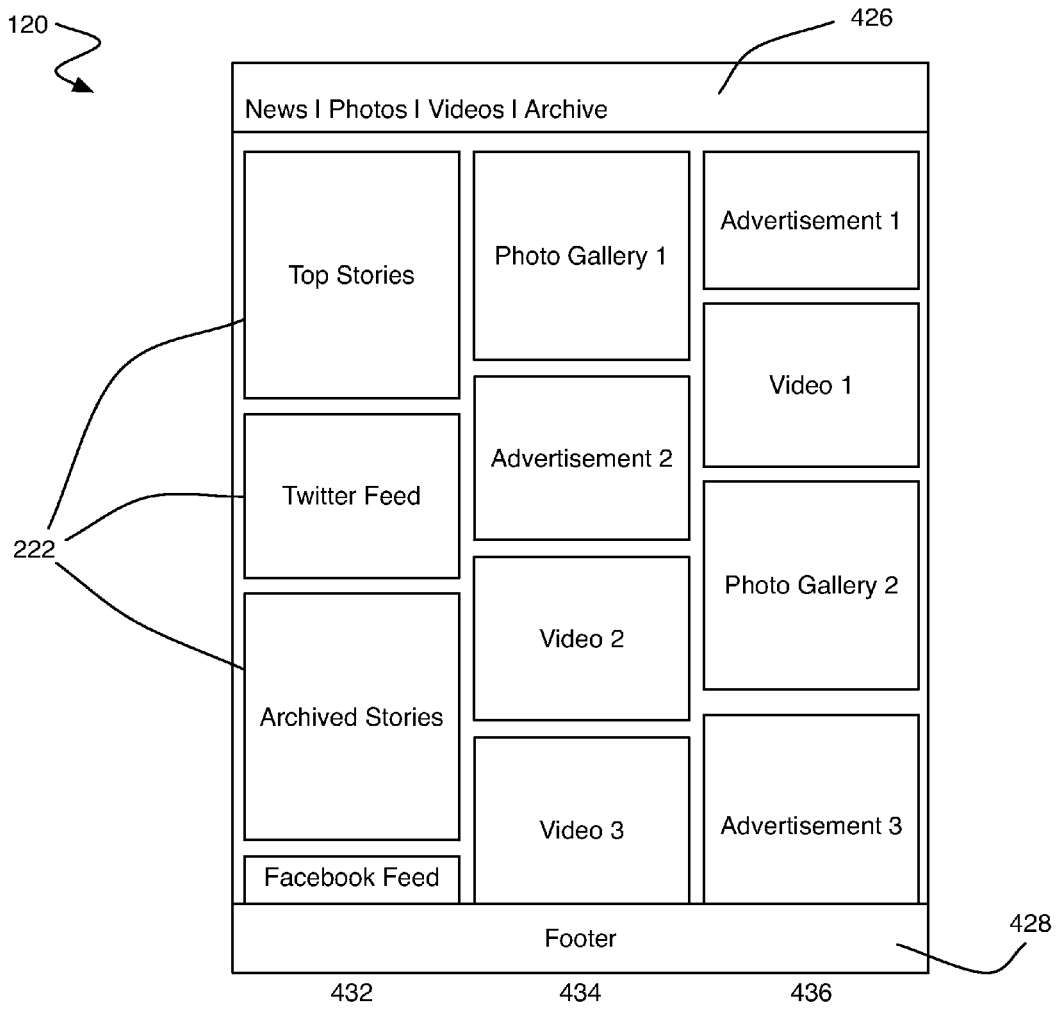
FIG. 4 depicts an exemplary screenshot of a graphical user interface comprising a plurality of data objects arranged within a 3-column layout area, in accordance with one embodiment of the present invention.

FIG. 4 depicts an exemplary screenshot of a graphical user interface 120 comprising a plurality of data objects 222 arranged within a 3-column layout area, in accordance with one embodiment of the present invention. Graphical user interface 120 may be displayed on a personal computing device, mobile device, television set, etc. Graphical user interface 120 comprises a header 426, footer 428, first column 432, second column 434, and third column 436. In this particular example, the user's display device 108 (FIG. 1) may have a resolution to display only three columns in the graphical user interface 120 at a time. For example, the user's display may be 1000 pixels wide. Since in this example each data object 222 has a data object size object property 329 (FIG. 3A and FIG. 3B) of 320 pixels in width, the user's display will only be able to display three columns of data objects 222. In another example, the user's display may be wider than 1000 pixels, but the user may have elected to size graphical user interface 120 such that only it is only 1000 pixels wide.

First column 432 comprises the following data objects 222: Top Stories, Twitter Feed, Archived Stories, and Facebook Feed. Second column 434 comprises the following data objects 222: Photo Gallery 1, Advertisement 2, Video 2, and Video 3.

Data objects 222 are arranged in a three column two-dimensional tessellated pattern. Each data object 222 is arranged such that a gap between data objects is consistent throughout the graphical user interface 120. Data objects 222 continue down the length of graphical user interface 120. For example, data objects 222 Facebook Feed, Video 3, and Advertisement 3 are cut off by footer 428 due to a maximum height of the user's display. However, the user can view the full dimensions of the mentioned data objects (Facebook Feed, Video 3, and Advertisement 3) by scrolling down on the graphical user interface 120 via a user input device 110 (FIG. 1). Furthermore, there may be more data object 222 content as the user continues to scroll even further down on the graphical user interface 120.

Data objects 222 are positioned within graphical user interface 120 based on object properties 324 (FIG. 3B). The system and method positions and resizes data objects 222 based on priority setting 327 (FIG. 3A), data object size 329 (FIG. 3A) and movability attribute 331 (FIG. 3A). Data objects having a movability attribute 331 (FIG. 3A) of "pinned" will be placed in their predefined positions within the graphical user interface 120, as described earlier. Data objects 222 having a movability attribute 331 (FIG. 3A) of "liquid" will be positioned around the "pinned" data objects 222 such that the data objects 222 are arranged in a two-dimensional tessellated pattern. The system and method updates a data object's 222 x-y coordinates object property 325 (FIG. 3A) upon positioning the data object 222 within the GUI 120. The system and method may resize a data object 222 by changing its data object size object property 329 to best fit the GUI 120 based on dimensions of the GUI 120. Specifically, the height value of the data object size object property 329 may be increased or decreased while the width value of the data object size object property 329 remains constant.

In an embodiment, the system may have a predefined criteria defining all data objects 222 should be placed in the top and leftmost location within the GUI 120, in order of the priority setting 327 (FIG. 3A) for each data object 222. It can be appreciated that the predefined criteria can define any position with the GUI 120 to be the optimal position, e.g. rightmost, topmost, bottommost, middle, etc.

In this specific example, data objects 222 "Photo Gallery 1" and "Video 1" are pinned to particular locations within the GUI 120. "Photo Gallery 1" is pinned to x-y coordinates (0, 1) within the GUI 120 and "Video 1" is pinned to x-y coordinates (1, 1.5) within the GUI 120. All other data objects 222 are liquid and are dynamically manipulated and positioned around the liquid data objects 222. For example, "Top Stories" is placed in the top and leftmost position because it has the highest priority of all the data objects (See FIG. 3B). Similarly, the other data objects 222 have been dynamically manipulated and positioned within the GUI 120 according to their object properties 324 (FIG. 3A) accordingly. It can be appreciated that the system and method has altered the height value of the data object size object property 329 for each data object 222 such that the data objects 222 fit in a two-dimensional tessellated pattern within the GUI 120.

In an embodiment, the predefined criteria within the system may also define certain rules for placement of data objects 222 with respect to each other. For example, there may be a rule where no two data objects 222 comprising advertisements may be placed bordering each other. In another example, there may be a rule where no two data objects 222 comprising advertisements from competing advertisers may be placed bordering each other. It can be appreciated that the predefined criteria for the system can include any number of rules defining placement of data objects 222 with respect to each other.

Header 426 comprises links for navigation between different categories of content within graphical user interface 120. For example, header 426 may include navigation links for News content, Photo content, Video content, and Archive content. Footer 428 may comprise other navigable links for content within the graphical user interface or may comprise links to third party source content.

In yet another embodiment, advertisements are interspersed between the data objects 222. The frequency of advertisements is defined within the predefined criteria of the system. For example, advertisements may be placed after every three data objects 222. Furthermore, the predefined criteria may include rules concerning strategic placement of advertisements. For example, no two advertisements may be positioned such that they border one another within the GUI 120.

In an even further embodiment, a third-party system interfaces with the data objects 222. The third-party system recognizes the data objects 222 and their associated object properties 324 (FIG. 3A). Taking into account and their object properties 324 (FIG. 3A), the third-party system locally integrates and displays the data objects 222 within its own GUI (not shown). The third-party system does not need to make any adjustments to object properties 324 (FIG. 3A) or data objects 222 for local display.

Figure 5:
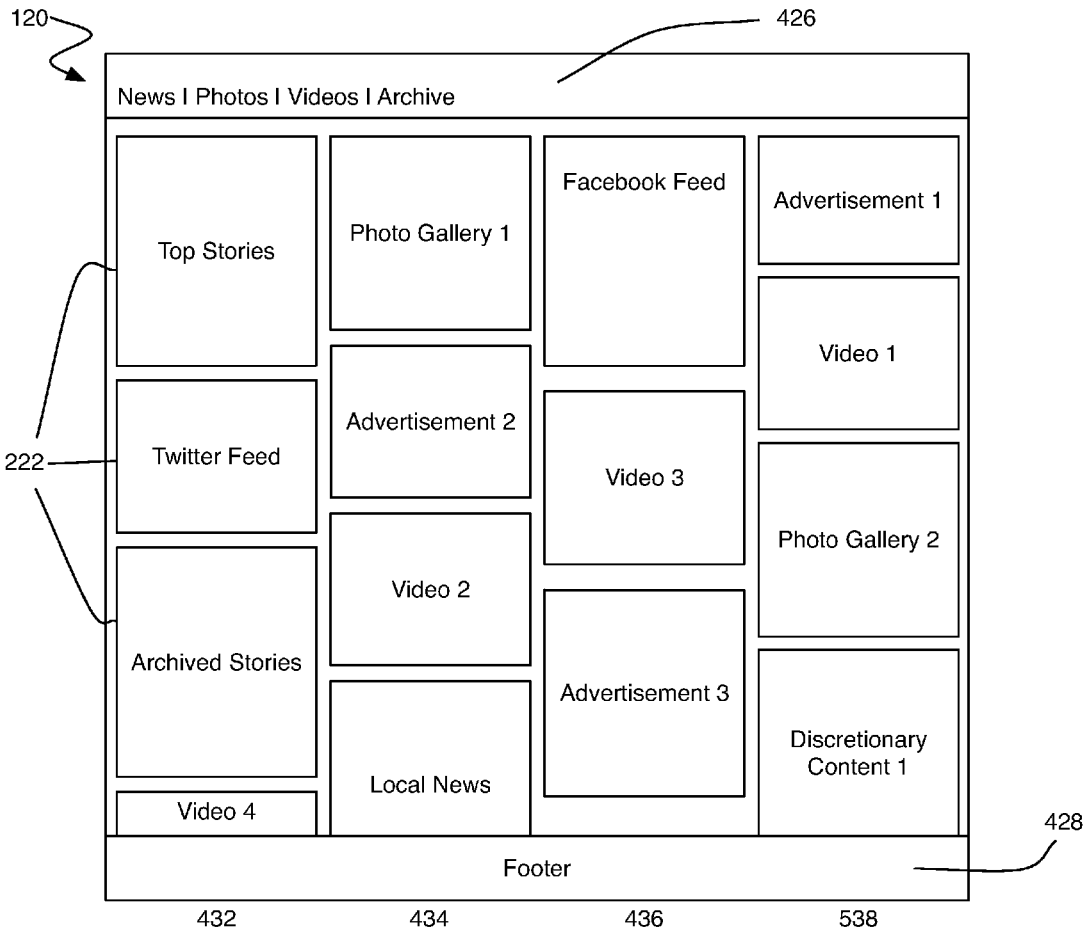
FIG. 5 depicts an exemplary screenshot of a graphical user interface comprising a plurality of data objects arranged within a 4-column layout area, in accordance with one embodiment of the present invention.

FIG. 5 depicts an exemplary screenshot of a graphical user interface 120 comprising a plurality of data objects 222 arranged within a 4-column layout area, in accordance with one embodiment of the present invention. FIG. 5 is similar to FIG. 4 with the addition of a fourth column 538. In this example, a user's display device may comprise enough horizontal pixels to support viewing of data objects 222 in a four column format and/or the user may have resized the GUI 120 to support viewing of data objects 222 in a four column format.

Data objects 222 previously displayed in the three column layout of FIG. 4 have been rearranged for optimal placement within the GUI 120. Specifically, data objects 222 that were not entirely visible without scrolling down within the GUI 120, i.e. "Facebook Feed," "Video 3," and "Advertisement 3" have been dynamically manipulated by the system and rearranged based on the object properties 324 displayed in FIG. 3B. In this example, data objects 222 "Video 4," "Local News," and "Discretionary Content 1" are not completely visible without a user having to scroll down further in the GUI 120 via user input device 110 (FIG. 1).

Figure 6:
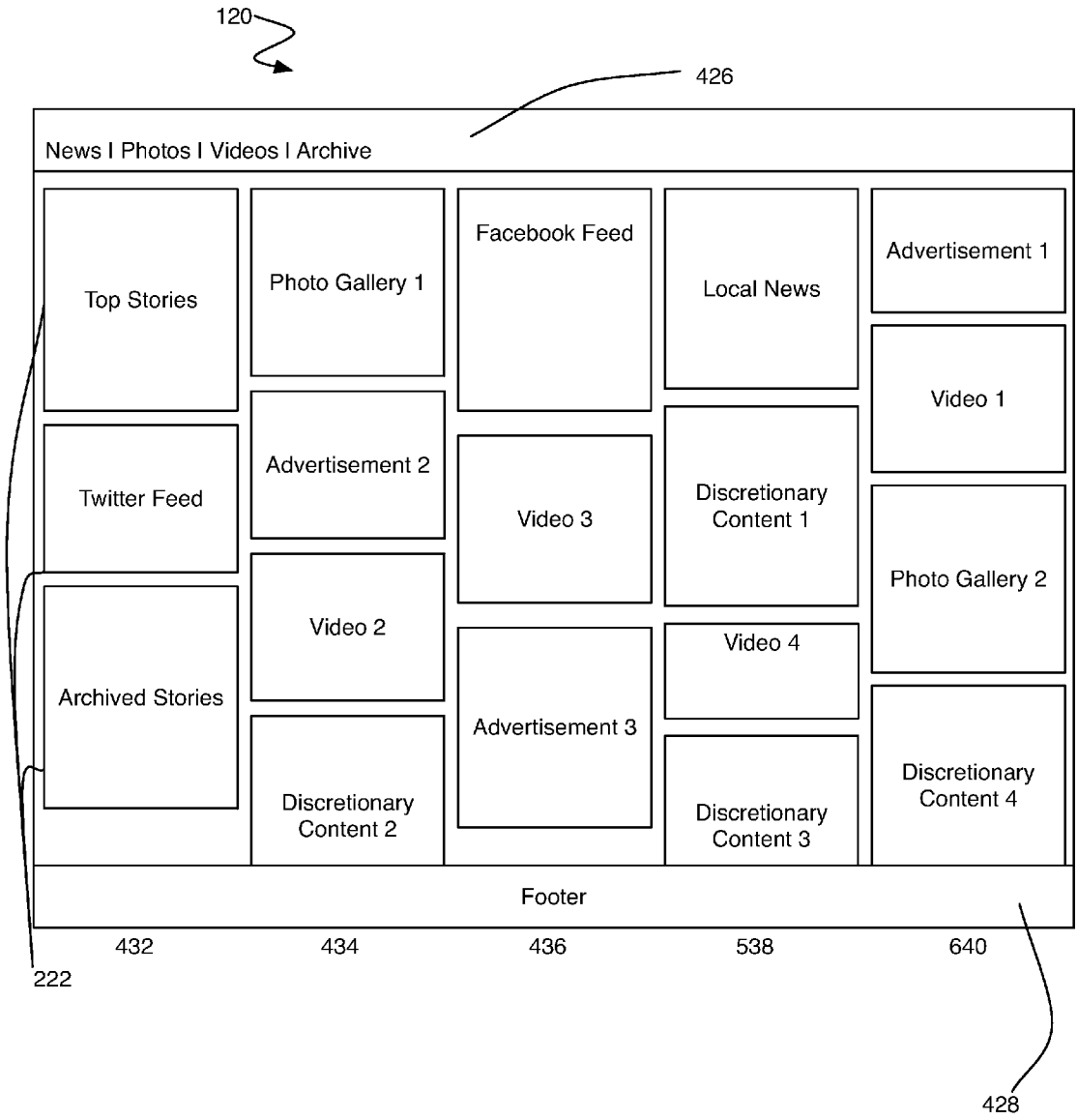
FIG. 6 depicts an exemplary screenshot of a graphical user interface comprising a plurality of data objects arranged within a 5-column layout area, in accordance with one embodiment of the present invention.

FIG. 6 depicts an exemplary screenshot of a graphical user interface 120 comprising a plurality of data objects 222 arranged within a 5-column layout area, in accordance with one embodiment of the present invention. FIG. 6 is similar to FIG. 5 with the addition of a fifth column 640. In this example, a user's display device may comprise enough horizontal pixels to support viewing of data objects 222 in a five column format and/or the user may have resized the GUI 120 to support viewing of data objects 222 in a five column format.

Data objects 222 previously displayed in the four column layout of FIG. 5 have been rearranged for optimal placement within the GUI 120. Specifically, data objects 222 that were not entirely visible without scrolling down within the GUI 120, i.e. "Video 4," "Local News," and "Discretionary Content 1" have been dynamically manipulated by the system and rearranged based on the object properties 324 displayed in FIG. 3B.

Figure 7:
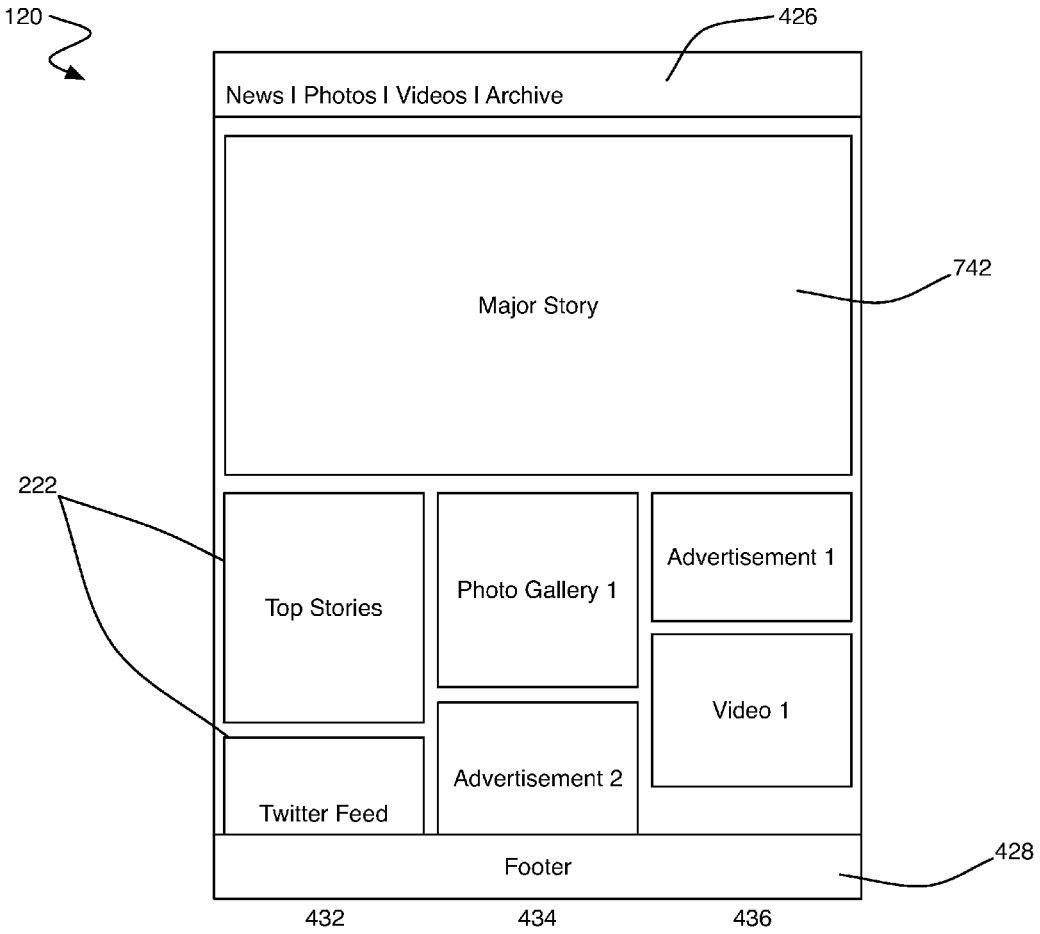
FIG. 7 depicts an exemplary screenshot of a graphical user interface comprising a plurality of data objects arranged under a major story data object, in accordance with one embodiment of the present invention.

FIG. 7 depicts an exemplary screenshot of a graphical user interface 120 comprising a plurality of data objects 222 arranged under a major story data object 742, in accordance with one embodiment of the present invention. Certain data objects 222 may be considered headline objects and defined within the predefined criteria of the system to display prominently in a specific location within the GUI 120. In this example, major story 742 is a headline object and displays prominently at the top of the GUI 120 and spans the majority of the three column layout. All other data objects 222 are arranged around (in this case, below) major story 742 to keep with the two-dimensional tessellated pattern and predefined criteria and object properties 324 (FIG. 3B) of the system and data objects 222.

Figure 7A:
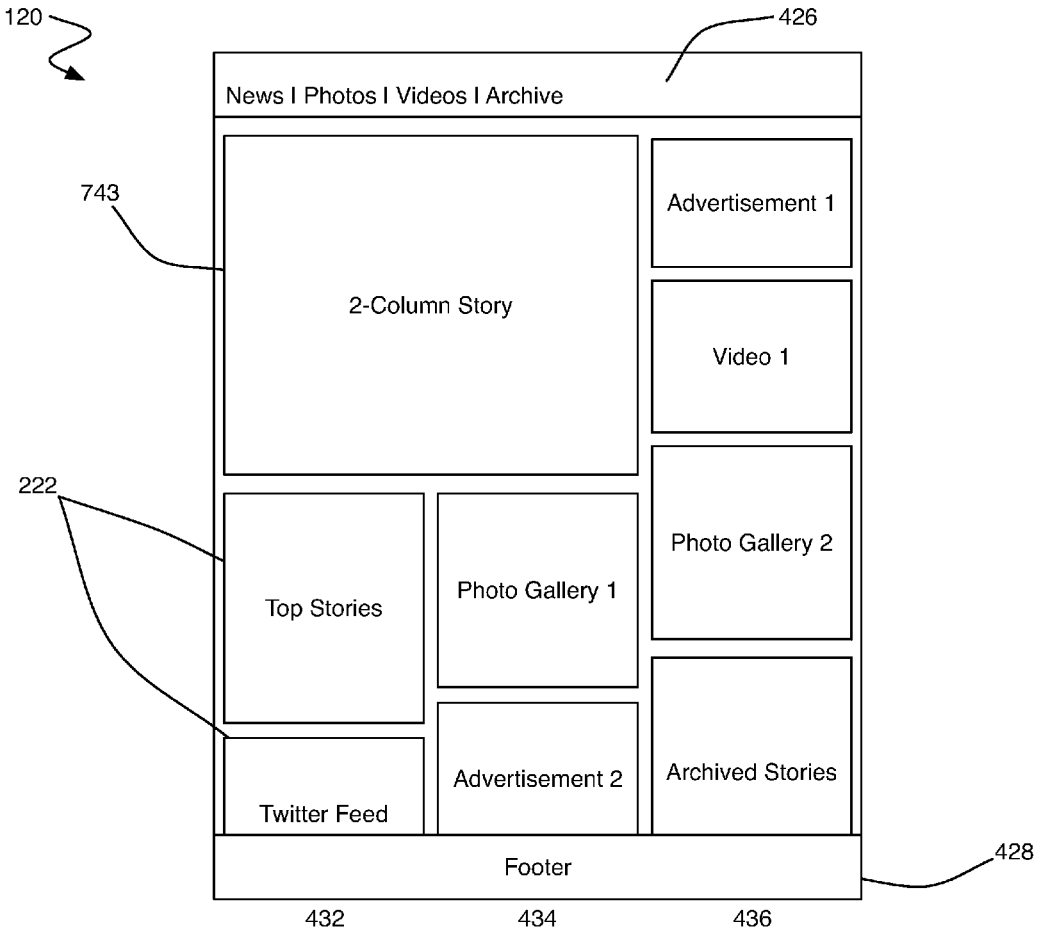
FIG. 7A depicts an exemplary screenshot of a graphical user interface comprising a plurality of data objects arranged under a 2-column wide data object, in accordance with one embodiment of the present invention.

FIG. 7A depicts an exemplary screenshot of a graphical user interface 120 comprising a plurality of data objects 222 arranged under a 2-column wide data object, in accordance with one embodiment of the present invention. Certain data objects 222 may be wider than one column. For example, a 2-column data object 743 may be displayed within the GUI 120. The 2-column data object 743 displays at the top of GUI 120 and spans 2-columns wide. All other data objects 222 are arranged around (and below) 2-column data object 743 to keep with the two-dimensional tessellated pattern and predefined criteria and object properties 324 (FIG. 3B) of the system and data objects 222. It can be appreciated that data objects 222 may be wider than 2-columns as well, e.g. 3-column and 4-column data objects.

Figure 8:
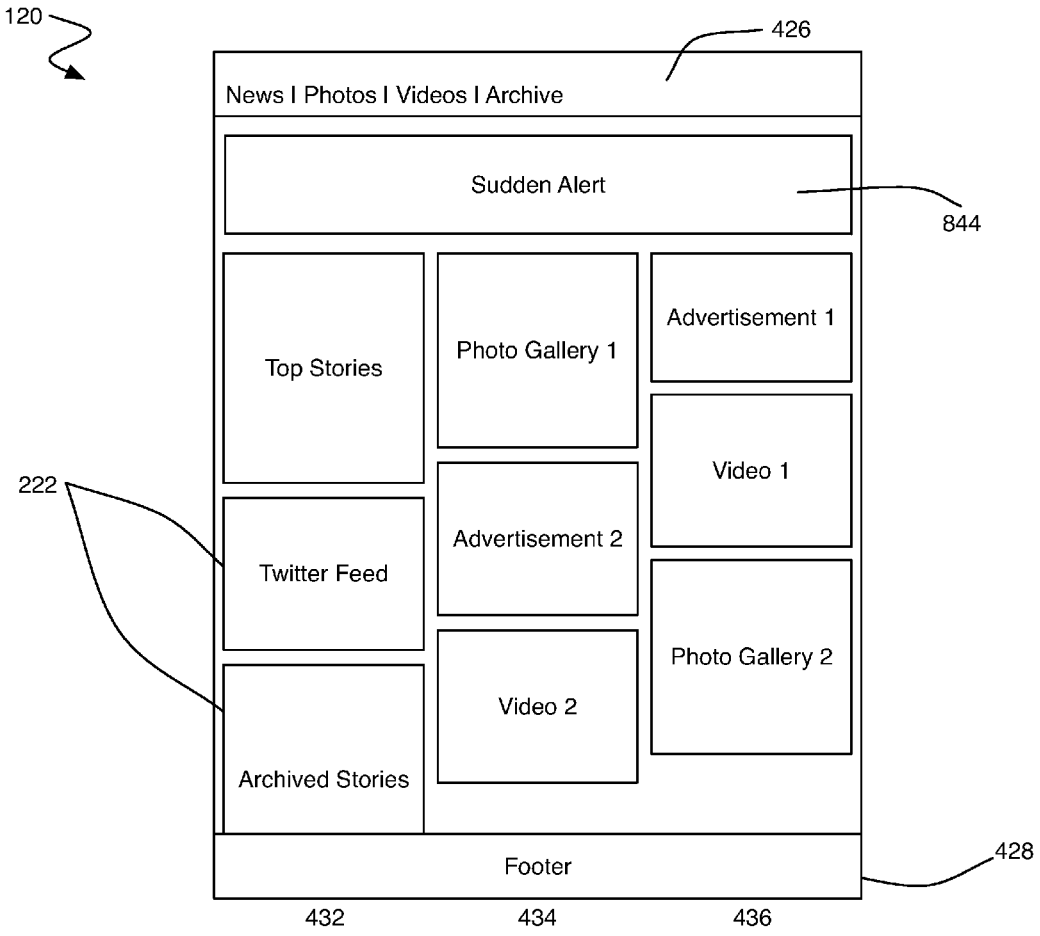
FIG. 8 depicts an exemplary screenshot of a graphical user interface comprising a plurality of data objects arranged under a sudden alert data object, in accordance with one embodiment of the present invention.

FIG. 8 depicts an exemplary screenshot of a graphical user interface 120 comprising a plurality of data objects 222 arranged under a sudden alert data object 844, in accordance with one embodiment of the present invention. FIG. 8 is similar to FIG. 7 with the exception that the headline object is a sudden alert data object 844. A sudden alert data object 844 may appear within the GUI 120 for a predefined time period and then disappear. The system and method accounts for sudden alert data object 844 when it is present and dynamically alters data objects 222 from their original positions to flow around sudden alert data object 844. When sudden alert data object 844 disappears, the system and method dynamically alters and repositions data objects 222 to place them in their original positions.

Figure 9:
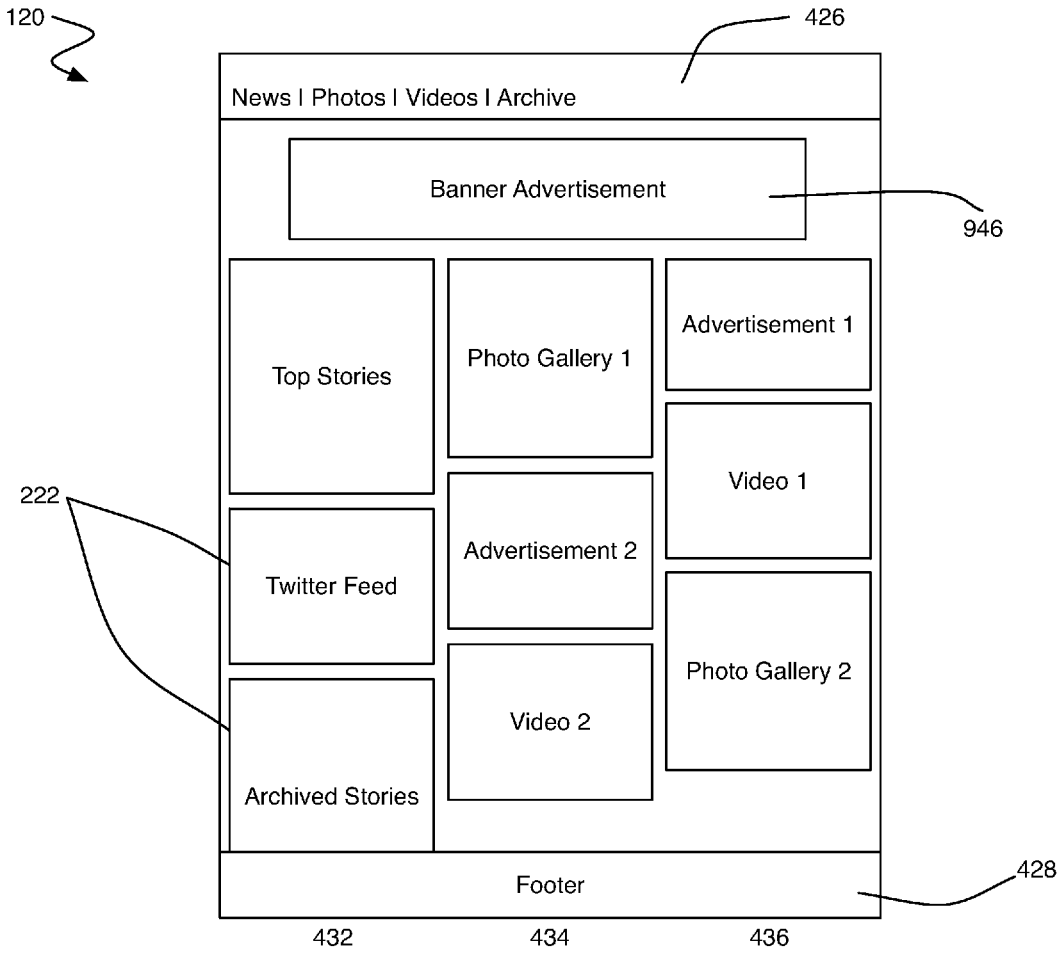
FIG. 9 depicts an exemplary screenshot of a graphical user interface comprising a plurality of data objects arranged under a banner advertisement, in accordance with one embodiment of the present invention.

FIG. 9 depicts an exemplary screenshot of a graphical user interface 120 comprising a plurality of data objects 222 arranged under a banner advertisement 946, in accordance with one embodiment of the present invention. FIG. 9 is similar to FIG. 7 with the exception that there is no headline object and instead there is a banner advertisement 946 at the top of the GUI 120. Banner advertisement 946 may be an advertisement from a third party advertiser who wishes to have the advertisement prominently displayed within the GUI 120. The system and method accounts for banner advertisement 946 and dynamically alters data objects 222 prior to positioning them within the GUI 120.

Figure 10:
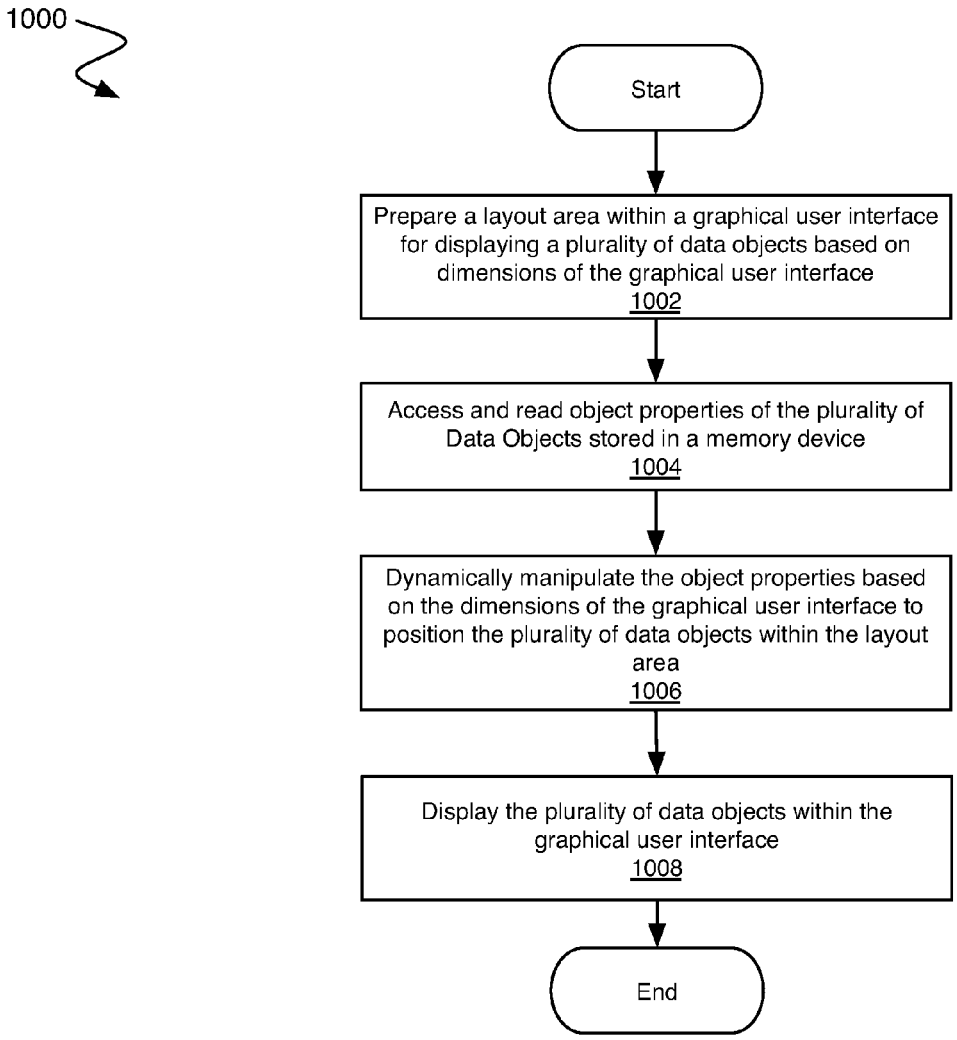
FIG. 10 depicts a flowchart of an exemplary computer controlled process of displaying a plurality of data objects within a graphical user interface, in accordance with one embodiment of the present invention.

FIG. 10 depicts a flowchart 1000 of an exemplary computer controlled process of displaying a plurality of data objects within a graphical user interface, in accordance with one embodiment of the present invention. In a block 1002, a layout area is prepared within a graphical user interface (GUI) for displaying a plurality of data objects based on dimensions of the GUI. The GUI resides within a personal computer, mobile device, television set, or any other device capable of displaying a GUI.

For example, in FIG. 4, a layout area within the GUI is prepared for displaying the plurality of data objects based on the dimensions of the GUI. The data objects may be text, photo, and/or video content.

In a block 1004, object properties of the data objects, stored in a memory device, are accessed and read. The object properties are associated with each data object. Object properties for data objects include: x-y coordinates, priority setting, data object size, and movability attribute.

The X-Y coordinates object property defines positional coordinates for a data object within the GUI. The position of each data object is defined using a two-dimensional Cartesian coordinate system, where the x-axis is taken to be horizontal and the y-axis is taken to be vertical.

The priority setting object property defines a priority for each data object. The priority for the data object is used in determining the placement of the data object within the GUI. Based on predefined rules, data objects with a higher priority setting will be placed in more favorable positions within the GUI while data objects with a lower priority setting will be placed in less favorable positions within the GUI. In an embodiment, the priority setting object property may be a number in a linear scale, e.g. the priority setting may be 4, on a scale of 1 to 10. In another embodiment, the priority setting object property may be high, medium, or low.

The data object size object property defines the dimensions for each data object. Data objects size comprises a height and a length, defined in terms of pixels. For example, a data object may comprise a width of 320 pixels and a height of 500 pixels. The system may alter the data object size property when positioning a data object within the GUI. In an embodiment, the width of a data object is fixed while the system dynamically alters the height of the data object for optimal placement within the GUI.

The movability attribute object property defines whether the data object may be repositioned to a different x-y coordinate within the GUI. The movability attribute object property for a particular data object may be set to either pinned or liquid. A data object is pinned when, according to a predefined rule, its position within the GUI is fixed and the system may not alter its x-y coordinate object property. A data object is dynamic when the system may alter its x-y coordinate object property for optimal placement of the data object within the GUI. In an embodiment, data objects having a dynamic movability attribute object property are positioned around data objects having a pinned movability attribute object property.

In a block 1006, the object properties are dynamically manipulated based on the dimensions of the GUI to position the plurality of data objects within the layout area. Data objects are positioned within the GUI based on object properties and dimensions of the GUI. The method positions and resizes data objects based on priority setting, data object size and movability attribute. Data objects having a movability attribute of "pinned" will be placed in their predefined positions within the graphical user interface. Data objects having a movability attribute of "liquid" will be positioned around the "pinned" data objects such that the data objects are arranged in a two-dimensional tessellated pattern. The system and method updates a data object's x-y coordinates object property upon positioning the data object within the GUI. The system and method may resize a data object by changing its data object size object property to best fit the GUI based on dimensions of the GUI. Specifically, the height value of the data object size object property may be increased or decreased while the width value of the data object size object property remains constant.

In a block 1008, the plurality of data objects are displayed within the graphical user interface. For example, in FIG. 4, the plurality of data objects are displayed within the GUI in a two-dimensional tessellated pattern. The GUI displays the plurality of data objects, along with a header and footer.

Figure 11:
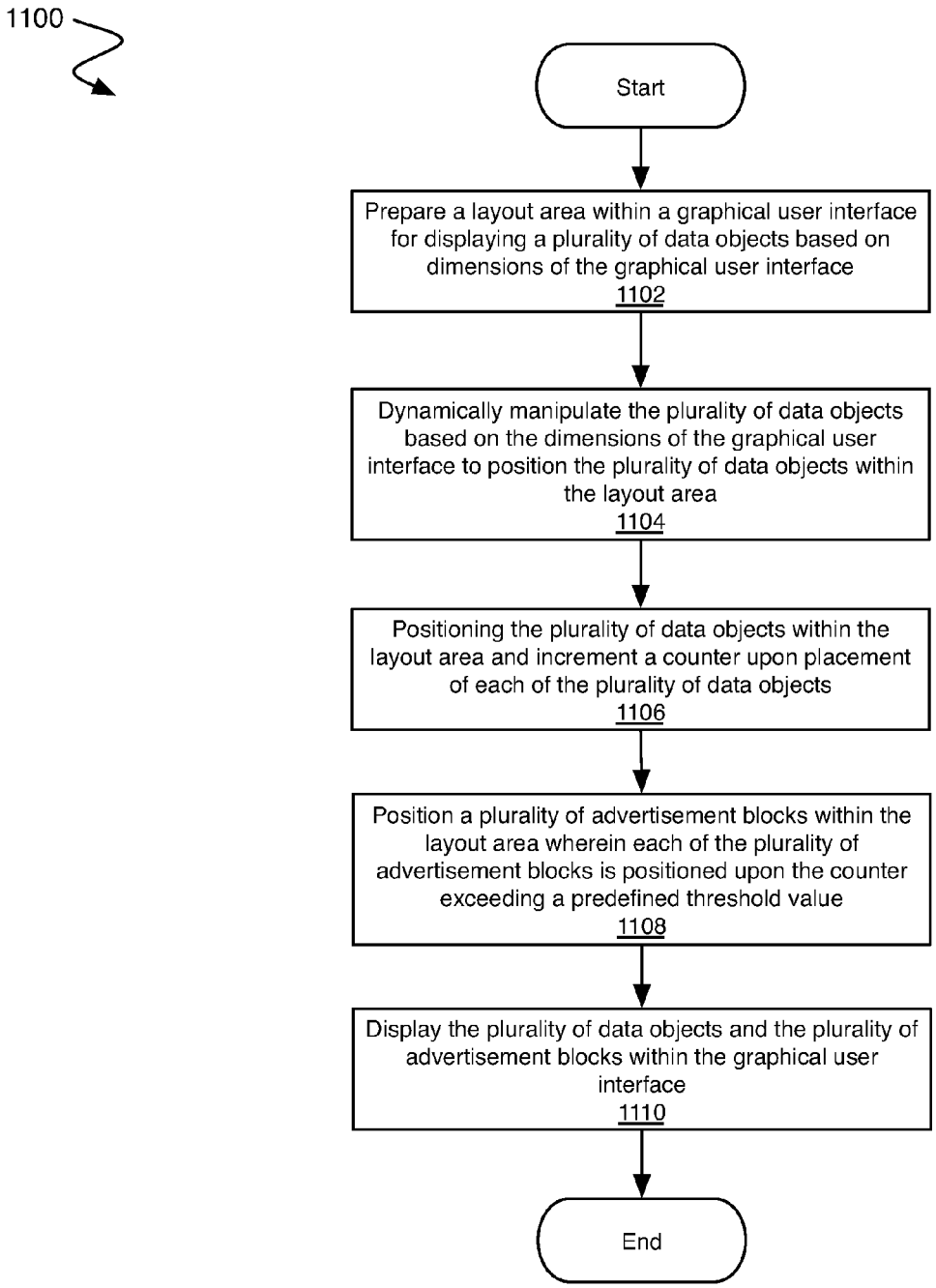
FIG. 11 depicts a flowchart of an exemplary computer controlled process of displaying a plurality of data objects and a plurality of advertisement blocks within a graphical user interface, in accordance with one embodiment of the present invention.

FIG. 11 depicts a flowchart 1100 of an exemplary computer controlled process of displaying a plurality of data objects and a plurality of advertisement blocks within a graphical user interface, in accordance with one embodiment of the present invention. In a block 1102, a layout area is prepared within a GUI for displaying a plurality of data objects based on dimensions of the GUI. The GUI resides within a personal computer, mobile device, television set, or any other device capable of displaying a GUI.

For example, in FIG. 4, a layout area within the GUI is prepared for displaying the plurality of data objects based on the dimensions of the GUI. The data objects may be text, photo, and/or video content.

In a block 1104, the object properties are dynamically manipulated based on the dimensions of the GUI to position the plurality of data objects within the layout area. Data objects are positioned within the GUI based on object properties and dimensions of the GUI. The method positions and resizes data objects based on priority setting, data object size and movability attribute. Data objects having a movability attribute of "pinned" will be placed in their predefined positions within the graphical user interface. Data objects having a movability attribute of "liquid" will be positioned around the "pinned" data objects such that the data objects are arranged in a two-dimensional tessellated pattern. The system and method updates a data object's x-y coordinates object property upon positioning the data object within the GUI. The system and method may resize a data object by changing its data object size object property to best fit the GUI based on dimensions of the GUI. Specifically, the height value of the data object size object property may be increased or decreased while the width value of the data object size object property remains constant.

In a block 1106, the plurality of data objects are positioned within the layout area and a counter is incremented upon placement of each of the plurality of data objects. For example, in FIG. 4, when each data object is placed within the GUI, the counter is incremented each time.

In a block 1108, a plurality of advertisement blocks are positioned within the layout area wherein each of the plurality of advertisements blocks is positioned upon the counter exceeding a predefined threshold value. After each data object is placed within the GUI the counter is incremented. When the counter reaches a predefined threshold value an advertisement block is interspersed within the data objects. In an embodiment, predefined criteria may also dictate certain rules for placement of advertisements with respect to each other. For example, there may be a rule where no two advertisements may be placed bordering each other. In another embodiment, there may be a rule where no two advertisements from competing advertisers may be placed bordering each other.

In a block 1110, the plurality of data objects and the plurality of advertisements blocks are displayed within the graphical user interface. For example, in FIG. 4, the plurality of data objects are displayed within the GUI in a two-dimensional tessellated pattern. The GUI displays the plurality of data objects, along with a header and footer. The GUI also includes three advertisement blocks interspersed within the data objects.

In the foregoing specification, embodiments of the invention have been described with reference to numerous specific details that may vary from implementation to implementation. Thus, the sole and exclusive indicator of what is, and is intended by the applicants to be, the invention is the set of claims that issue from this application, in the specific form in which such claims issue, including any subsequent correction. Hence, no limitation, element, property, feature, advantage, or attribute that is not expressly recited in a claim should limit the scope of such claim in any way. Accordingly, the specification and drawings are to be regarded in an illustrative rather than a restrictive sense.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

What is claimed is:

1. A computer-implemented method of manipulating data objects, the computer-implemented method comprising:

in a computer system, assigning a plurality of properties to each of a plurality of data objects, the plurality of properties including a priority property and a movability property;

in the computer system, determining a first number of columns of data objects that fits within a first width of a first layout area;

in the computer system, determining a first plurality of locations within the first number of columns in the first layout area to display the plurality of data objects;

in the computer system, determining a rank order for each of the first plurality of locations;

in the computer system, positioning the plurality of data objects at the first plurality of locations in the first layout area based on the priority property of each data object and the rank order of each location unless the movability property of the data object defines a specific location for the data object in the first layout area; and displaying the plurality of data objects at the first plurality of locations based on the positioning, wherein the data object with a highest priority is displayed at a location with a highest ranked order in the first layout area unless the movability property of the data object with the highest priority defines a specific location in the first layout area for the data object with the highest priority.

2. The computer-implemented method of claim 1, further comprising:

in the computer system, determining a second number of columns of data objects that fits within a second width of a second layout area when the second width of the second layout area differs from the first width of the first layout area;

in the computer system, determining a second plurality of locations within the second number of columns in the second layout area; and in the computer system, determining a rank order for each of the second plurality of locations.

3. The computer-implemented method of claim 2, further comprising:

in the computer system, repositioning the plurality of data objects at the second plurality of locations in the second layout area based on the priority property of each data object and the rank order of the second plurality of locations unless the movability property of the data object defines a specific location in the second layout area; and displaying the plurality of data objects at the second plurality of locations based on the repositioning, wherein the data object with the highest priority is displayed at a location with a highest ranked order unless the movability property of the data object with the highest priority defines a specific location in the second layout area for the data object with the highest priority.

4. The computer-implemented method of claim 3, further comprising displaying the data object with the highest priority at a location that corresponds with a specific location in the second layout area defined by the movability property of the data object with the highest priority.

5. The computer-implemented method of claim 3, wherein an X-Y location of the data object with the highest priority in the first layout area is different from an X-Y location of the data object with the highest priority in the second layout area when no specific location for the data object with the highest priority is defined by the movability property.

6. The computer-implemented method of claim 3, wherein an X-Y location of the data object with the highest priority in the first layout area is the same as an X-Y location of the data object with the highest priority in the second layout area when a specific location for the data object with the highest priority is defined.

7. The computer-implemented method of claim 3, wherein the plurality of data objects have a plurality of widths where at least one data object has a first width and at least one data object has a second width that is an integer multiple of the first width.

8. The computer-implemented method of claim 3, further comprising in the computer system, adjusting a height of a data object to fit into the first layout area.

9. The computer-implemented method of claim 3, wherein the plurality of data objects includes advertisement blocks and one or more of text, photo, and video content, wherein the advertisement blocks are positioned in the first layout area based on a counter and a predetermined counter threshold value.

10. The computer-implemented method of claim 1, further comprising:

in the computer system, determining to display an alert object in the first layout area, wherein the alert object is to be displayed in the first layout area for a predetermined time period; and in the computer system, repositioning the plurality of data objects within the first layout area based on the determination to display the alert object for the predetermined time period.

11. An apparatus to manipulate data objects, the apparatus comprising:

a a computer system configured to:

assign a plurality of properties to each of a plurality of data objects, the plurality of properties including a priority property and a movability property;

determine a first number of columns of data objects that fits within a first width of a first layout area;

determine a first plurality of locations within the first number of columns in the first layout area to display the plurality of data objects;

determine a rank order for each of the first plurality of locations; and position the plurality of data objects at the first plurality of locations in the first layout area based on the priority property of each data object and the rank order of each location unless the movability property of the data object defines a specific location for the data object in the first layout area; and a display coupled to the computer system, the display configured to display the plurality of data objects at the first plurality of locations based on the positioning, wherein the data object with a highest priority is displayed at a location with a highest ranked order in the first layout area unless the movability property of the data object with the highest priority defines a specific location in the first layout area for the data object with the highest priority.

12. The apparatus of claim 11, wherein the computer system is further configured to:

determine a second number of columns of data objects that fits within a second width of a second layout area when the second width of the second layout area differs from the first width of the first layout area;

determine a second plurality of locations within the second number of columns in the second layout area; and determine a rank order for each of the second plurality of locations.

13. The apparatus of claim 12, wherein:

the computer system is further configured to reposition the plurality of data objects at the second plurality of locations in the second layout area based on the priority property of each data object and the rank order of the second plurality of locations unless the movability property of the data object defines a specific location in the second layout area; and the display is further configured to display the plurality of data objects at the second plurality of locations based on the repositioning, wherein the data object with the highest priority is displayed at a location with a highest ranked order unless the movability property of the data object with the highest priority defines a specific location in the second layout area for the data object with the highest priority.

14. The apparatus of claim 13, wherein the display is further configured to display the data object with the highest priority at a location that corresponds with a specific location in the second layout area defined by the movability property of the data object with the highest priority.

15. The apparatus of claim 13, wherein an X-Y location of the data object with the highest priority in the first layout area is different from an X-Y location of the data object with the highest priority in the second layout area when no specific location for the data object with the highest priority is defined by the movability property.

16. The apparatus of claim 13, wherein an X-Y location of the data object with the highest priority in the first layout area is the same as an X-Y location of the data object with the highest priority in the second layout area when a specific location for the data object with the highest priority is defined.

17. The apparatus of claim 13, wherein the plurality of data objects have a plurality of widths where at least one data object has a first width and at least one data object has a second width that is an integer multiple of the first width.

18. The apparatus of claim 13, wherein the computer system is further configured to adjust a height of a data object to fit into the first layout area.

19. The apparatus of claim 13, wherein the plurality of data objects includes advertisement blocks and one or more of text, photo, and video content, and wherein the advertisement blocks are positioned in the first layout area based on a counter and a predetermined counter threshold value.

20. The apparatus of claim 11, wherein the computer system is further configured to:

determine to display an alert object in the first layout area, wherein the alert object is displayed in the first layout area for a predetermined time period; and reposition the plurality of data objects within the first layout area based on the determination to display the alert object for the predetermined time period.

21. An apparatus to manipulate a plurality of data objects, the apparatus comprising:

a memory that stores a first database and a second database;

a processor coupled to the memory, the processor being configured to:

assign a plurality of properties to each of the plurality of data objects stored in the first database, the plurality of properties being stored in the second database and including a priority property and a movability property;

determine a first number of columns of data objects that fits within a first width of a first layout area;

determine a first plurality of locations within the first number of columns in the first layout area to display the plurality of data objects;

determine a rank order for each of the first plurality of locations; and position the plurality of data objects at the first plurality of locations in the first layout area based on the priority property of each data object and the rank order of each location unless the movability property of the data object defines a specific location for the data object in the first layout area; and a display coupled to the processor, the display being configured to display the plurality of data objects at the first plurality of locations based on the positioning, wherein the data object with a highest priority is displayed at a location with a highest ranked order in the first layout area unless the movability property of the data object with the highest priority defines a specific location in the first layout area for the data object with the highest priority.

22. The apparatus of claim 21, wherein the processor is further configured to:

determine a second number of columns of data objects that fits within a second width of a second layout area when the second width of the second layout area differs from the first width of the first layout area;

determine a second plurality of locations within the second number of columns in the second layout area; and determine a rank order for each of the second plurality of locations.

* * * * *